US007779790B2

(12) United States Patent
Fabrizio

(10) Patent No.: US 7,779,790 B2
(45) Date of Patent: Aug. 24, 2010

(54) ELECTRIC TANKLESS WATER HEATER

(75) Inventor: Edward Vincent Fabrizio, Vernon, CT (US)

(73) Assignee: Eemax, Inc., Oxford, CT (US)

( * ) Notice: Subject to any disclaimer, the term of this patent is extended or adjusted under 35 U.S.C. 154(b) by 1691 days.

(21) Appl. No.: 10/913,921

(22) Filed: Aug. 6, 2004

(65) Prior Publication Data

US 2006/0027673 A1 Feb. 9, 2006

(51) Int. Cl.
*F22B 27/00* (2006.01)

(52) U.S. Cl. ..... 122/40; 122/4 A; 392/485

(58) Field of Classification Search ..... 237/2 A; 392/485, 450, 486; 219/501, 486, 492; 122/40, 122/4 A
See application file for complete search history.

(56) References Cited

U.S. PATENT DOCUMENTS

| | | | | | |
|---|---|---|---|---|---|
| 2,700,505 | A | * | 1/1955 | Jackson | 236/9 R |
| 3,088,017 | A | * | 4/1963 | Schomann | 392/494 |
| 3,952,182 | A | * | 4/1976 | Flanders | 392/466 |
| 3,968,346 | A | | 7/1976 | Cooksley | |
| 4,041,275 | A | * | 8/1977 | Gerdes | 392/492 |
| 4,095,087 | A | * | 6/1978 | Giraud | 392/471 |
| 4,410,791 | A | | 10/1983 | Eastep | |
| 4,439,669 | A | | 3/1984 | Ryffel | |
| 4,567,350 | A | | 1/1986 | Todd et al. | |
| 4,604,515 | A | * | 8/1986 | Davidson | 392/492 |
| 4,638,147 | A | | 1/1987 | Dytch et al. | |
| 4,762,980 | A | * | 8/1988 | Insley | 392/494 |
| 4,900,896 | A | | 2/1990 | Maus | |
| 4,960,976 | A | | 10/1990 | Insley | |
| 5,020,127 | A | | 5/1991 | Eddas et al. | |
| 5,216,743 | A | | 6/1993 | Seitz | |
| 5,222,185 | A | | 6/1993 | McCord | |
| 5,325,822 | A | | 7/1994 | Fernandez | |
| 5,332,884 | A | * | 7/1994 | Bailey | 219/494 |
| 5,408,578 | A | * | 4/1995 | Bolivar | 392/490 |
| 5,437,003 | A | | 7/1995 | Blanco | |
| 5,438,642 | A | | 8/1995 | Posen | |
| 5,440,667 | A | | 8/1995 | Simpson et al. | |
| 5,479,558 | A | | 12/1995 | White, Jr. et al. | |
| 5,504,306 | A | | 4/1996 | Russell et al. | |

(Continued)

OTHER PUBLICATIONS

The Wholesaler®, May 2003; 57.

(Continued)

*Primary Examiner*—Gregory A Wilson
(74) *Attorney, Agent, or Firm*—Choate Hall & Stewart LLP; John D. Lanza

(57) ABSTRACT

In various aspects, the present invention provides an electric tankless liquid heater system capable of delivering liquid, such as, for example, water, with an acceptable increase in output liquid temperature upon a sudden and substantial decrease in liquid demand. In various aspects, the electric tankless liquid heater comprises an inlet manifold and a plurality of liquid heaters the inlets of which are connected in a parallel flow relationship by the inlet manifold, and the outlets of which are each connected to a separate outlet conduit, and which is configured to provide water to a plurality of automatic water fixtures with a less than about 2° F. (about 1.1° C.) increase in output water temperature upon about a one-and-a-half-fold or greater decrease in water demand that occurs in less than about 500 milliseconds as measured by the increase time of the inlet liquid pressure.

29 Claims, 12 Drawing Sheets

U.S. PATENT DOCUMENTS

| | | | | |
|---|---|---|---|---|
| 5,523,550 | A | 6/1996 | Kimura | |
| 6,061,499 | A | 5/2000 | Hlebovy | |
| 6,080,971 | A * | 6/2000 | Seitz et al. | 219/483 |
| 6,167,845 | B1 | 1/2001 | Decker et al. | |
| 6,240,250 | B1 | 5/2001 | Blanco | |
| 6,389,226 | B1 * | 5/2002 | Neale et al. | 392/485 |
| 6,539,171 | B2 * | 3/2003 | VonArx et al. | 392/451 |
| 6,539,173 | B2 * | 3/2003 | Chu | 392/486 |
| 6,574,426 | B1 | 6/2003 | Blanco | |
| 6,640,048 | B2 | 10/2003 | Novotny et al. | |
| 6,909,843 | B1 * | 6/2005 | Fabrizio | 392/490 |
| 2001/0048811 | A1 | 12/2001 | Waithe et al. | |
| 2003/0044173 | A1 | 3/2003 | Natsuhara et al. | |
| 2003/0113107 | A1 | 6/2003 | Winter et al. | |
| 2003/0185548 | A1 | 10/2003 | Novotny et al. | |
| 2003/0206733 | A1 | 11/2003 | Hadar | |

OTHER PUBLICATIONS

"Non-Final Rejection," U.S. Appl. No. 10/785,813, issued as U.S. Pat. 6,909,843, Sep. 21, 2004.
"Final Rejection," U.S. Appl. 10/993,795, Dec. 27, 2006.
"Non-Final Rejection," U.S. Appl. No. 10/993,795, Dec. 12, 2005.
"Terminal Disclaimer Under 37 CFR 1.321," filed Dec. 21, 2007.

* cited by examiner

ELECTRIC TANKLESS WATER HEATER

BACKGROUND

The most common approach for providing hot water in both domestic and commercial settings involves the use of large tanks for the storage of hot water. Although such heated tank systems can provide hot water at a relatively high flow rate, they are inherently energy inefficient because the water in the tank is continually reheated even when water is not being used on a regular basis.

Another approach to providing hot water involves the use of a tankless water heater system that heats water only when hot water is being used. Such tankless water heater systems, also referred to as demand water heater systems, can often provide a more energy efficient means of heating water than storage systems using the same type of heating (e.g., gas, electric, etc.). However, one common draw back of traditional tankless water heater systems is the occurrence of temperature spikes upon changes in hot water demand. Traditional reservoir type hot water heaters typically do not experience temperature spikes with changes in hot water demand as hot water is provided from a water reservoir of substantially uniform temperature. In a traditional reservoir system, when hot water demand increases the system simply provides more hot water from the reservoir (until the hot water runs out). Should hot water demand suddenly decrease, the temperature of the hot water is not changed because it comes from a reservoir of constant temperature water.

In contrast, in a typical tankless hot water heater system, when hot water-demand increases the system must increase the energy output of its heating elements to respond to the increased demand (and concomitant increased input water flow rate). Temperature spikes in the output water can then occur when there is a sudden decrease in hot water demand because of the delay in adjusting the energy output of the heating elements for the reduction in input water flow rate. Such temperature spikes in the flow from water fixtures for human use (e.g., sinks, showers, etc.), besides being unpleasant, can cause a person to reflexively jerk their hand away from the water stream, which can pose risks to equipment or others if the person happens to be washing a fragile or sharp piece of equipment at the time.

Temperature spikes can be particularly troublesome for fixtures with automatic faucets (e.g., touch-free faucets) because of the very rapid shut-off characteristic (typically about 50 milliseconds) of the solenoid valves used in such faucets. However, automatic faucets are finding increasing use in commercial and public settings owing to their advantages in sanitation provided by their touch-free use (e.g., food-borne illness, infection, etc.) and water conservation.

There are many industrial, commercial and residential uses to which a tankless hot water system capable of delivering hot water with reduced temperature spikes could be applied. In addition to uses as more energy efficient residential, commercial and industrial hot water supplies for multiple water fixtures (e.g., multiple sinks, multiple showers), tankless hot water systems with reduced temperature spikes could be used to provide hot water for multiple portable, semi-portable or fixed decontamination showers, which in times of heavy use, for example, could be subject to repeated and rapid changes in hot water demand (e.g., showers being turned on and off repeatedly).

A need therefore continues to exist for hot water delivery systems that can provide hot water in a more energy efficient manner than storage tank systems yet without the objectionable temperature spikes upon sudden changes in hot water demand found in traditional electric tankless hot water heater systems.

SUMMARY OF THE INVENTION

The present invention relates to electric tankless liquid heater systems, and in particular, to electric tankless water heater systems using resistive heating elements. In various aspects, the present invention provides an electric tankless liquid heater system capable of delivering liquid with an acceptable increase in output liquid temperature upon a sudden and substantial decrease in liquid demand. In various embodiments, the acceptable increase in liquid temperature is an increase less than about one or more of: (i) 3° F. (about 1.7° C.); (ii) 2° F. (about 1.1° C.); (iii) 1.5° F. (about 0.8° C.); and/or (iv) 1° F. (about 0.6° C.). In various embodiments, the substantial decrease in liquid demand is a decrease in demand greater than about one or more of: (i) one-and-a-half-fold decrease (i.e., about 33% reduction); (ii) two-fold decrease (i.e., 50% reduction); (iii) three-fold decrease (i.e., about 66% reduction); and/or (iv) four-fold decrease (i.e., 75% reduction); in liquid demand. In some embodiments, the decrease in liquid demand is about a two-fold decrease from about 1 gpm (about 3.8 liters per minute (lpm)) to about 0.5 gpm (about 1.9 lpm). In some embodiments, the decrease in water demand is about a three-fold decrease from about 1.5 gpm (about 5.7 lpm) to about 0.5 gpm (about 1.9 lpm). In various embodiments, the sudden decrease is a decrease that occurs in less than about one or more of: (i) 2 seconds; (ii) 1 second; (iii) 500 milliseconds; (iv) 250 milliseconds; (v) 75 milliseconds; and/or (vi) 50 milliseconds.

In various aspects, the electric tankless liquid heater comprises an inlet manifold and a plurality of liquid heaters the inlets of which are connected in a parallel flow relationship by the inlet manifold, and the outlets of which are each connected to a separate outlet conduit. The outlet conduit, for example, can be a pipe, tubing, etc., for connecting the electric tankless liquid heater to a fixture.

In various aspects of the invention, the liquid heaters are used as water heaters. There are primarily two types of electrical heating elements traditionally used in water heaters: inductance and resistance. The present invention makes use of electrical resistance heating elements. Electrical resistance heating elements are immersed into the water to be heated. Electrical resistance heating elements heat up as current passes through them and the amount of heat generated is related to the resistance of the element. Heat is then transferred from the heating element to the water.

There are also two primary types of electrical resistance heating elements: sheathed and sheathless. Sheathed electrical resistance heating elements have an electrically insulative sleeve or sheath over a more electrically conductive inner element, such as, e.g., a metal wire. The inner element is heated by passing a current therethrough, and heat is then transferred from the inner element to the water. The sheath serves, for example, to prevent direct physical contact between the water to be heated and the conductive inner element. In comparison, in a sheathless electrical resistance heating element, the portion of the element which is heated by passing a current therethrough can come into direct physical contact with the liquid being heated.

In the various aspects of the invention, the liquid heaters comprise one or more electrical resistance heating elements for heating the liquid. Preferably, the electrical resistance heating elements are continuous, sheathless, coils having a mechanically stressed portion that bridges a liquid inlet channel and a liquid outlet channel of a liquid heater and an electrically conductive member configured to substantially eliminate current flow through the mechanically stressed portion.

In various embodiments, a liquid heater preferably comprises a housing having a liquid inlet channel and a liquid outlet channel, the housing defining a central passage opening into an exterior housing surface, and a heating cartridge resident in the central passage, the heating cartridge supporting interiorly of the housing the one or more electrical resistance heating elements. Preferably, a liquid heater further comprises a flow sensor operably disposed in the liquid inlet channel responsive to the flow rate of the liquid through the liquid inlet channel, and which is configured to prevent energization of the one or more heating elements of a liquid heater when the flow rate through the liquid inlet channel of said liquid heater is below a predetermined flow rate threshold. It is also preferred that a liquid heater further comprise a temperature sensor operably disposed in the liquid outlet channel and a controller configured to regulate electrical current flow to the electrical resistance heating element in response to a signal produced by the temperature sensor.

In various embodiments, an electric tankless liquid heater of the present invention includes a controller, which regulates the current flow to one or more electrical resistance heaters of a liquid heater. In preferred embodiments, the controller regulates electrical current flow to one or more electrical resistance heating elements in response to a signal produced by a temperature sensor, a flow sensor, or both. Preferably, the controller is configured to prevent energizing an electrical resistance heating element of the liquid heater until the flow rate of the liquid through the liquid inlet channel exceeds a predetermined flow rate threshold. In various embodiments of an electric tankless liquid heater of the present invention, electrical current is provided to one or more electrical resistance heating elements through a circuit relay installed in series with one or more switching units.

In various embodiments, the present invention provides an electric tankless liquid heater system capable of delivering hot water to an outlet conduit with less than about a: (i) 3° F. (about 1.7° C.); (ii) 2° F. (about 1.1° C.); (iii) 1.5° F. (about 0.8° C.); and/or (iv) 1° F. (about 0.6° C.); increase in output water temperature for a greater than about: (i) one-and-a-half-fold sudden decrease (i.e., about 33% reduction); (ii) two-fold sudden decrease (i.e., 50% reduction); (iii) three-fold sudden decrease (i.e., about 66% reduction); and/or (iv) four-fold sudden decrease (i.e., 75% reduction); in water demand.

In various embodiments, the sudden decrease in water demand is a decrease that occurs in less than about: (a) 500 milliseconds, (b) 250 milliseconds, (c) 75 milliseconds, and/or (d) 50 milliseconds; as measured by the shut-off time of one or more valves which control the flow of liquid through one or more outlet conduits of the electric tankless liquid heater system. In various embodiments, the sudden decrease in water demand is a decrease that occurs in less than about: (a) 500 milliseconds, (b) 250 milliseconds, (c) 75 milliseconds, and/or (d) 50 milliseconds; as measured by the increase time of the inlet water pressure. In various embodiments, the sudden decrease in water demand is a decrease that occurs in less than about: (a) 2 seconds, (b) 1 second, (c) 500 milliseconds, (d) 250 milliseconds, and/or (e) 75 milliseconds; as measured by the decrease time of the measured input liquid flow rate. In various preferred embodiments, the time it takes for the decrease in liquid demand to occur is preferably measured by the increase time of the inlet liquid pressure.

In preferred embodiments, the electric tankless liquid heater systems of the present invention are configured to provide water to a plurality of automatic water fixtures with a less than about 2° F. (about 1.1° C.) increase in output water temperature upon about a three-fold or greater decrease in water demand that occurs in less than about 500 milliseconds as measured by the increase time of the inlet liquid pressure.

In some embodiments, the decrease in water demand is about a one-and-a-half fold decrease from about 1.5 gpm (about 5.7 liters per minute (lpm)) to about 1.0 gpm (about 3.8 lpm). In some embodiments, the decrease in water demand is about a two-fold decrease from about 1 gpm (about 3.8 lpm) to about 0.5 gpm (about 1.9 lpm). In some embodiments, the decrease in water demand is about a three-fold decrease from about 1.5 gpm (about 5.7 lpm) to about 0.5 gpm (about 1.9 lpm).

In preferred aspects, the tankless liquid heater of the present invention includes a controller, which provides thermostatic control, for example, by monitoring one or more of liquid outlet temperature, inlet flow rate, and outlet flow rate; and adjusting the energization of liquid heaters and the current flow to one or more electrical resistance heating elements. In various embodiments, the controller adjusts the energization of liquid heaters and the current flow to one or more electrical resistance heating elements to facilitate maintaining liquid outlet temperature below a maximum temperature value. In various embodiments, the maximum temperature value is in the range between about 102° F. to about 106° F., and preferably the maximum temperature value is about 105° F.

In various embodiments, the controller adjusts the energization of liquid heaters and the current flow to one or more electrical resistance heating elements to facilitate maintaining liquid outlet temperature within a selected temperature range. In various embodiments, the selected temperature range is the range between about 100° F. to about 105° F., and preferably the selected temperature range is the range between about 104° F. to about 105° F.

Accordingly, in various embodiments, the present invention provides tankless water heaters systems for provision of hot water to a multiple water fixtures including, but not limited to, showers, sinks, and tools.

The foregoing and other aspects, embodiments, and features of the invention can be more fully understood from the following description in conjunction with the accompanying drawings. In the drawings like reference characters generally refer to like features and structural elements throughout the various figures. The drawings are not necessarily to scale, emphasis instead being placed upon illustrating the principles of the invention.

BRIEF DESCRIPTION OF THE DRAWINGS

FIG. 4A is a sectional view, FIG. 4B a side view, FIG. 4C a switching unit side, side view, and FIG. 4D a proximate end, end view of the liquid heater. The various dimensions illustrated in FIGS. 4B and 4C are in inches.

DETAILED DESCRIPTION

Figure 1:
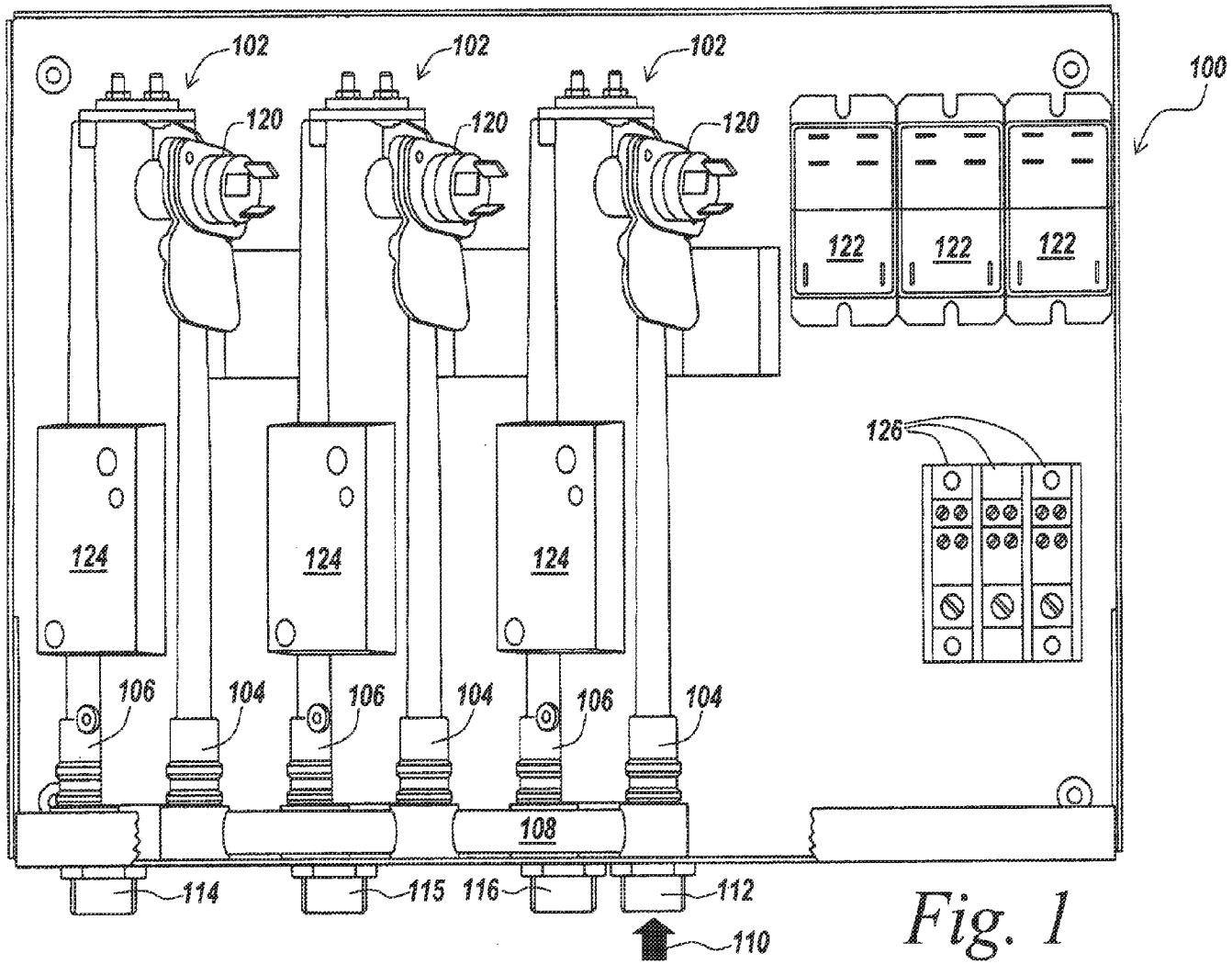
FIG. 1 is an assembly drawing illustrating various embodiments of an electric tankless liquid heater system in accordance with the present invention.

Referring to FIG. 1, in various embodiments, a tankless water heater system 100 according to the invention comprises a plurality of liquid heaters 102 each having a liquid inlet 104 and a liquid outlet 106. The liquid inlets 104 of the liquid heaters 102 are connected in a parallel flow relationship by an inlet manifold 108, which in turn can be connected to a source of liquid 110 to be heated, such as, e.g., a cold water line, by an inlet manifold connection fitting 112. The liquid outlets 106 of the liquid heaters 102 are each connected to a separate outlet conduit 114, 115, 116. Each outlet conduit can be, for example, connected to a separate fixture for the supply of hot liquid.

In the various aspects of the invention, each liquid heater includes one or more electrical resistance heating elements. The electrical power to the electrical resistance heating elements preferably passes through a switching unit 120 and, preferably, a separate circuit relay (also referred to as a contactor) 122 for each liquid heater. A controller 124, in various embodiments mounted on the liquid heater, regulates the operation of a switching unit 120 and hence the current flow to one or more electrical resistance heaters of a liquid heater. The circuit relays 122, and therethrough one or more switching units, are connected to a source of electrical power through taps in terminal blocks 126, which are connected to a source of electrical power (e.g., line voltage). Preferably, use is also made of a ground terminal block. Preferably, a separate circuit relay 122 is used to energize or "arm" each switching unit and each switching unit regulates electrical current flow to the one or more electrical resistance heating elements connected thereto.

The controller furnishes an output control signal to a switching unit (such as, e.g., a bi-directional triode thyristor or "triac"), which gates power from a terminal block for selectively energizing one or more electrical resistance heating elements of a liquid heater. Solid state switching units, such as triacs, used alone can have some leakage current as they deteriorate, or if their blocking voltage rating has been exceeded. The present invention thus preferably utilizes a circuit relay installed in series with one or more switching units. In preferred embodiments, the controller regulates electrical current flow to one or more electrical resistance heating elements in response to a signal produced by a temperature sensor, a flow sensor, or both. Preferably, the controller is configured to prevent energizing an electrical resistance-heating element of the liquid heater until the flow rate of the liquid through the liquid inlet channel exceeds a predetermined flow rate threshold. In various embodiments, the controller is configured to prevent energizing an electrical resistance-heating element of the liquid heater until the flow rate exceeds about 0.4 gpm. Preferably, the liquid heater includes a temperature sensor, operably disposed in a liquid outlet channel of the liquid heater, which provides a signal to the controller for regulating electrical current flow to one or more electrical resistance heating elements and maintaining a desired output liquid temperature for the tankless liquid heater system.

A tankless liquid heater system according to the invention can be mounted in a housing comprising an enclosure containing mounting points for electrical components (for example, circuit relays, and terminal blocks) in addition to the liquid heaters. In various embodiments, the liquid heaters are mounted to the casing at an angle using angle brackets which are directly mounted to the enclosure. In one embodiment, comprising a first plurality of three liquid heaters, the casing has the dimensions of about 15 inches wide, by about 12 inches high, by about 4 inches deep.

Figure 2:
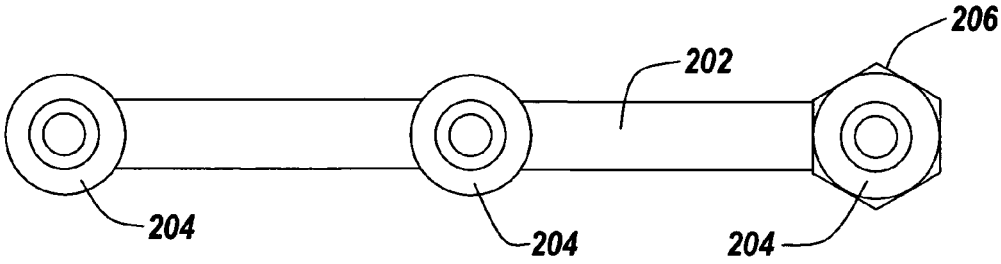
FIGS. 2 and 3 are detailed views of one embodiment of an inlet manifold.
Figure 3:
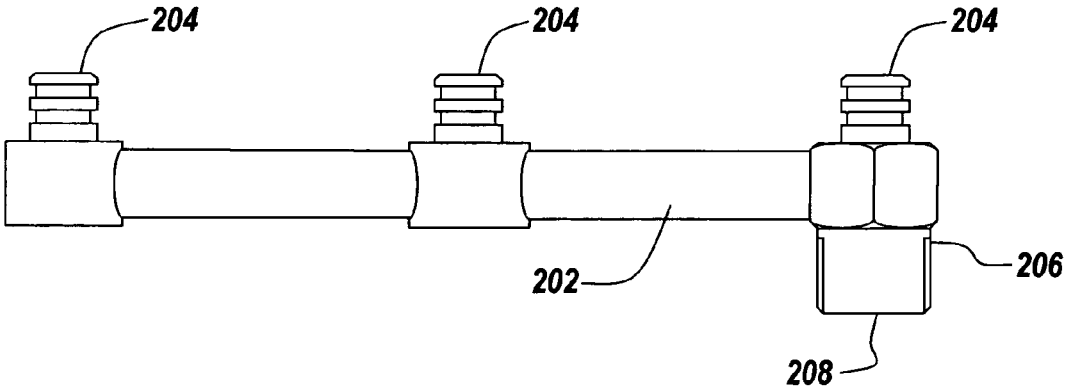
Figure 4A:
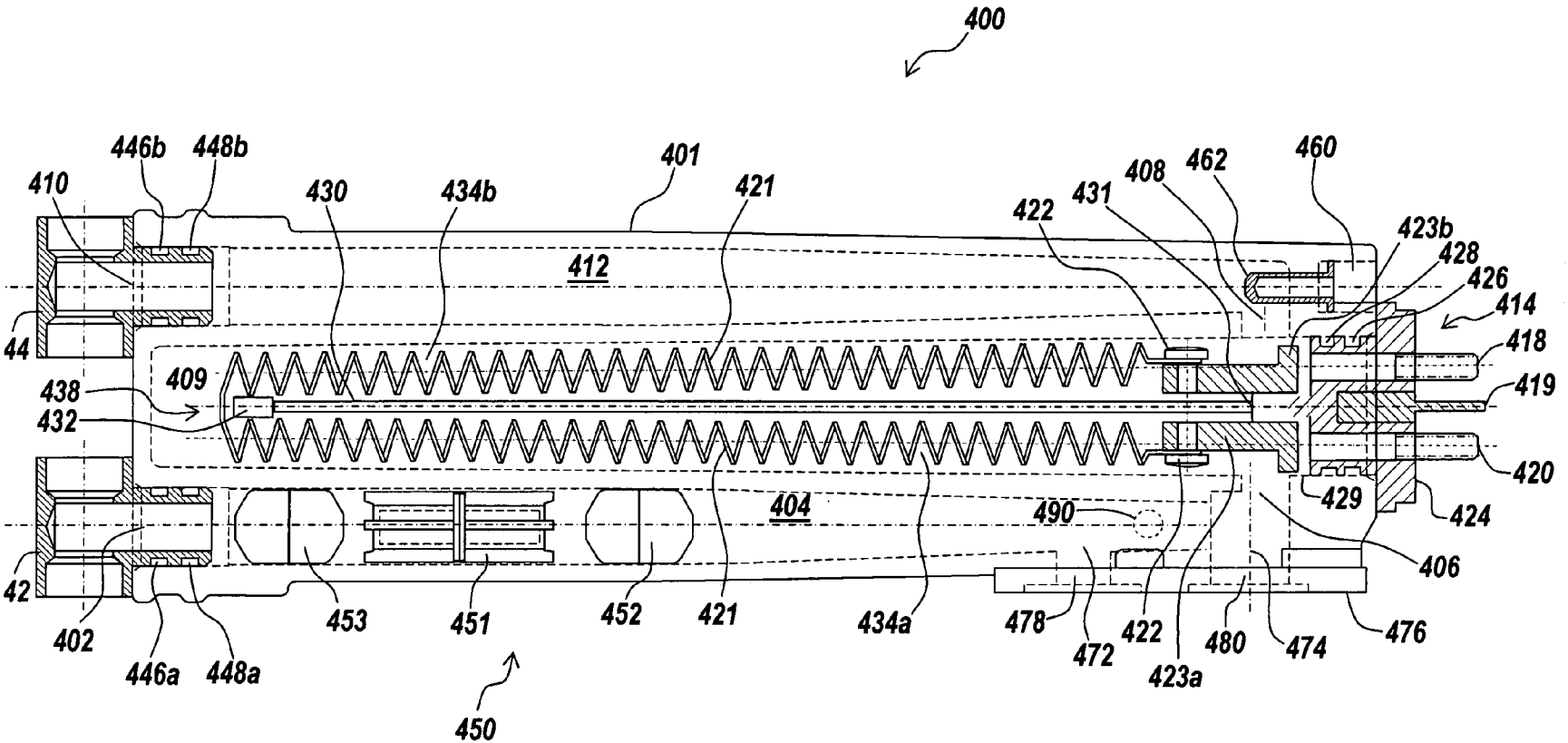
FIGS. 4A-4D are various views of one embodiment of a liquid heater for an electric tankless liquid heater system in accordance with the present invention; where
Figure 4B:
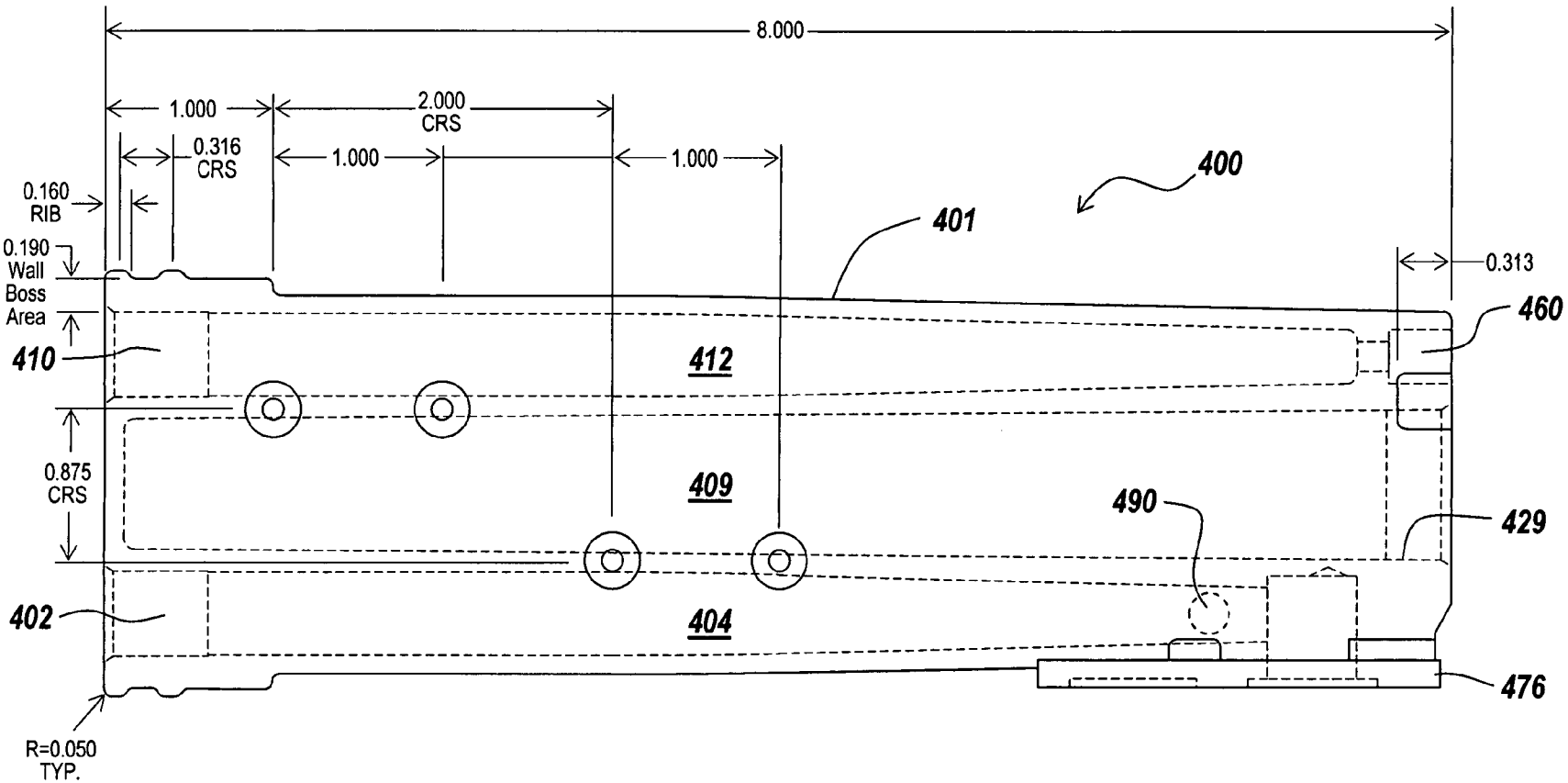
Figure 4C:
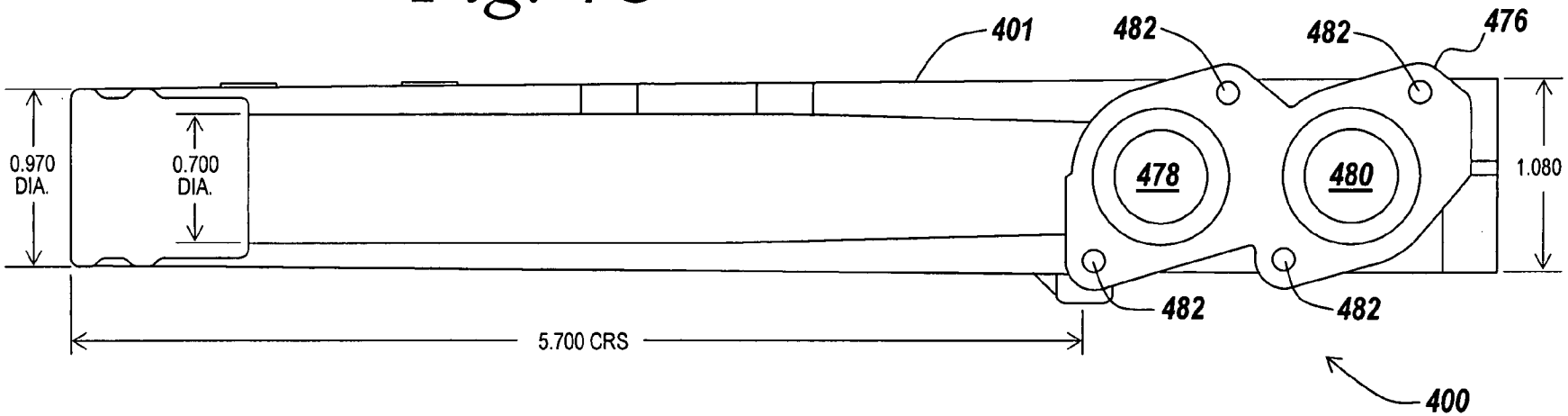
Figure 4D:
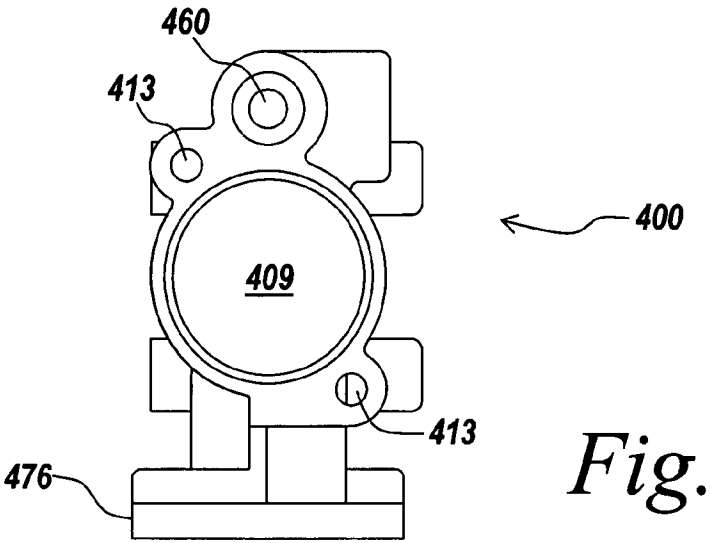

FIGS. 2 and 3 provide top (FIG. 2) and side views (FIG. 3), respectively, of one embodiment of an inlet manifold suitable for use in a tankless electric liquid heater system of the invention. In general, the inlet manifold comprises a manifold line 202 connecting, in a liquid flow relationship, heater connection fittings 204 for connecting the inlet manifold to the liquid inlets of a liquid heater. The inlet manifold further comprises a manifold connection fitting 206 (e.g. a boss having an integrally threaded portion) having an interconnection portion 208 for coupling the inlet manifold to a source of liquid.

In preferred embodiments, an inlet manifold comprises a manifold line of one-half inch copper tubing and each heater connection fitting comprises a brass boss having one-half inch bores and two circumferential indents each for seating an one-half inch O-ring to provide a seal against the inlet channel of a liquid heater when the liquid heater is seated thereon. Preferably, the O-rings are of buna-n-nitrile, and preferably the heater connection fittings are soldered to the manifold line. The manifold connection fitting preferably comprises a brass boss having a five-eighths-inch bore and an interconnection portion suitable for accepting a compression fitting. In various embodiments including a coupling line, preferably the coupling line is three-quarter inch copper tubing and the coupling portion utilizes a one-inch buna-n-nitrile O-ring to circumferentially seal against the coupling line.

Referring to FIGS. 4A-4D, in various embodiments, a liquid heater 400 comprises a housing 401 having a liquid inlet 402, a liquid inlet channel 404 integrally including the liquid inlet 402, cross channels 406, 408 communicating with a central channel 409, a liquid outlet 410, and a liquid outlet channel 412 integrally including the liquid outlet 410. The liquid heater further comprises a heater cartridge 414, which preferably is fully separable from the housing 401 and capable of being removed and replaced without disconnecting the housing 401 from the inlet manifold and outlet conduits. Preferably, the heating cartridge 414 is releasably secured to the liquid heater housing 401 by removable fasteners inserted in securement openings 413 (e.g., passages for bolts, threaded holes for screws), and it can be seen in FIGS. 1 and 4A-4D that the heater cartridge 414 can be readily released from the liquid heater without disturbing the existing mounting of the liquid heater and its plumbing connections to the inlet manifold and outlet conduits.

The heater cartridge 414 comprises termination rods 418, 420 for electrically connecting an electrical resistance heating element 421 to a switching unit, and can further include an electrically insulative element divider 419. The electrical resistance heating element 421 is connected by fasteners 422 (e.g., screws) to members 423*a*, 423*b*, which are connected to their respective termination rods and which provide a flat surface portion for better securement against the member and better electrical contact between the electrical resistance heating element 421 and the member than a curved surface.

The termination rods 418, 420 are supported by a heater cartridge head 424 having head portion indents 426, 428 for seating O-rings, which become radially compressed and seal the cartridge head 424 against the walls of the central channel at the proximate end 429 of the housing 401 when the heater cartridge 414 is inserted into the central channel 409.

The heater cartridge 414 further comprises a web 430 having a proximate end 431 connected to the cartridge head 424 and an electrically conductive member 432 at the distal end. The web 430 and electrically conductive member 432 define in the central channel 409 successive first and second interior channels 434*a*, 434*b* in fluid communication, respectively, with the liquid inlet channel 404 and the liquid outlet channel 412. In preferred embodiments, the electrical resistance heating element 421 is arranged in a generally U-shaped configuration, bridging about the distal end of the web 430. This bridging by a portion of the electrical resistance-heating element places this portion 438 under mechanical stress and defines a mechanically stressed portion 438 of the electrical resistance heating element 421. The electrically conductive member 432 is disposed on the distal end of the web 430 in electrical contact with at least a portion of the electrical resistance heating element preceding and with a portion following the mechanically stressed portion 438 to shunt current flow across the electrically conductive member 432 and thereby substantially eliminate the electrical current flow through the mechanically stressed portion bridging the distal end of the web 430.

Preferably, the electrical resistance heating elements are continuous, sheathless, coils. Preferred electrical resistance heating elements materials include, but are not limited to, nickel-chromium alloys, and iron-chromium-aluminum alloys. Examples of suitable commercially available wire for utilization in electrical resistance heating elements include NIKROTHAL 80 PLUS (an 80/20 NiCr alloy wire manufactured by Kanthal International, Hallstahammar, Sweden and available from Kanthal, Bethel, Conn., USA), NICR-A (an 80/20 NiCr alloy wire manufactured by National Element Inc., N.C., USA), KANTHAL-D (a FeCrAl alloy wire manufactured by Kanthal), and FECRAL815 (a FeCrAl alloy wire manufactured by National). Preferred wire B&S gauges ranges from about 20 (about 0.0320 inch diameter wire) to about 25 (about 0.0179 inch diameter wire) depending on the wire material, operating voltage, current and power.

In specific applications, the desired power dissipation of an electrical resistance heating element can vary typically from about 2.4 to 4.2 kilowatts (kW), for, for example, input flow rates between about 0.4 gpm to about 1 gpm. In these various applications, the wire diameter of an electrical resistance-heating element is preferably selected to maintain a safe "watt-density" (e.g., watts per inch squared) during operation and facilitates maintaining a constant range of power per surface area during operation. Various examples of water temperature rises provided by various embodiments of the present invention substantially similar to those illustrated in FIGS. 1-3 ("a three-outlet conduit design") using liquid heaters substantially similar to that of FIGS. 4A-4D, for various values of electrical resistance heating element and operational parameters, are listed in Tables 1 below.

TABLE 1

| Voltage (volts) | Total Amps | Total kW | kW each heater | Temperature Rise ° F. at 0.5 gpm (each heater) |
|---|---|---|---|---|
| 208 | 46 | 9.6 | 3.2 | 44 |
| 240 | 46 | 11.0 | 3.67 | 50 |
| 277 | 46 | 12.6 | 4.2 | 57 |

Table 2 below lists examples of water temperature rises provided by various embodiments of the present invention similar to those illustrated in FIGS. 1-3 which have only two liquid heaters ("a two-outlet conduit design") liquid heaters with substantially similar to that of FIGS. 4A-4D, for various values of electrical resistance heating element and operational parameters.

TABLE 2

| Voltage (volts) | Total Amps | Total kW | kW each heater | Temperature Rise ° F. at 0.5 gpm (each heater) |
|---|---|---|---|---|
| 208 | 31 | 6.4 | 3.2 | 44 |
| 240 | 31 | 7.3 | 3.67 | 50 |
| 277 | 31 | 8.4 | 4.2 | 57 |

Referring again to FIGS. 4A-4D, in preferred embodiments, the liquid inlet 402 of a liquid heater is connected to an inlet manifold by inlet heater connection fitting 442, and the liquid outlet 410 of a liquid heater is connected to an outlet conduit by an outlet heater connection fitting 444. The heater connection fittings having indents 446*a*, 446*b*, 448*a*, 448*b* for seating O-rings, which upon insertion of the heater connection fittings into the liquid inlet 402 and liquid outlet 410, become radially compressed and seal, respectively, the inlet heater connection fitting 442 in the liquid inlet channel 404 and the outlet heater connection fitting 444 in the liquid outlet channel 412.

In preferred embodiments, the liquid heater 400 includes a flow sensor 450 operably disposed in the liquid inlet channel 404 and responsive to the flow rate of liquid through the liquid inlet channel 404, the flow sensor 450. Preferably, the flow sensor 450 comprises a rotometer including a magnetic portion 451 slidably disposed in the liquid inlet channel 404, and travel stops 452, 453. In operation, liquid flow through the liquid inlet channel 404 of a sufficient flow rate forces the magnetic portion 451 towards the downstream travel stop 452. In preferred embodiments, the controller is responsive to the position of the magnetic portion 451 within the liquid inlet channel 404. For example, in various embodiments, at sufficient liquid flow rates through the liquid inlet channel 404 the position of the magnetic portion 451 aligns with one or more magnetically activatable switches of the controller such that the magnetically activatable switches permit the energization of the electrical resistance heating element 421.

It is also preferred that the liquid heater include a temperature sensor, such as, for example, a thermistor. In various embodiments, the housing 401 has a temperature sensor receipt opening 460 in the proximate end of the housing for insertion of a temperature sensor 462 therein, to dispose at least a portion of the temperature sensor 462 in the liquid outlet channel 412.

In various embodiments, one or more switching units (such as, for example, triacs) are supported on the liquid heater housing 401 and in fluid communication with the liquid inlet channel 404 to assist in preventing overheating of the switching unit. In one embodiment, housing 401 has side openings 472, 474 formed in a sidewall thereof and a mounting plate 476 for mounting the switching units, the mounting plate 476 having plate openings 478, 480 and bolt securement passages 482 adjacent same for securing switching units thereto.

The liquid heater further preferably includes a pressure relief valve incorporated in the housing. Referring to FIGS. 4A-4D, in various embodiments, the pressure relief valve comprises a valve mechanism seated in a passage 490 in the housing 401, which is in fluid communication with the liquid inlet channel 404. In preferred embodiments, the pressure relief valve is a re-setable valve mechanism having a spring-loaded brass piston and seat. In various embodiments where the housing is rated for a maximum operating pressure of 150 psi, the pressure relief valve is preferably set to start actuation at 170 psi.

Figure 5A:
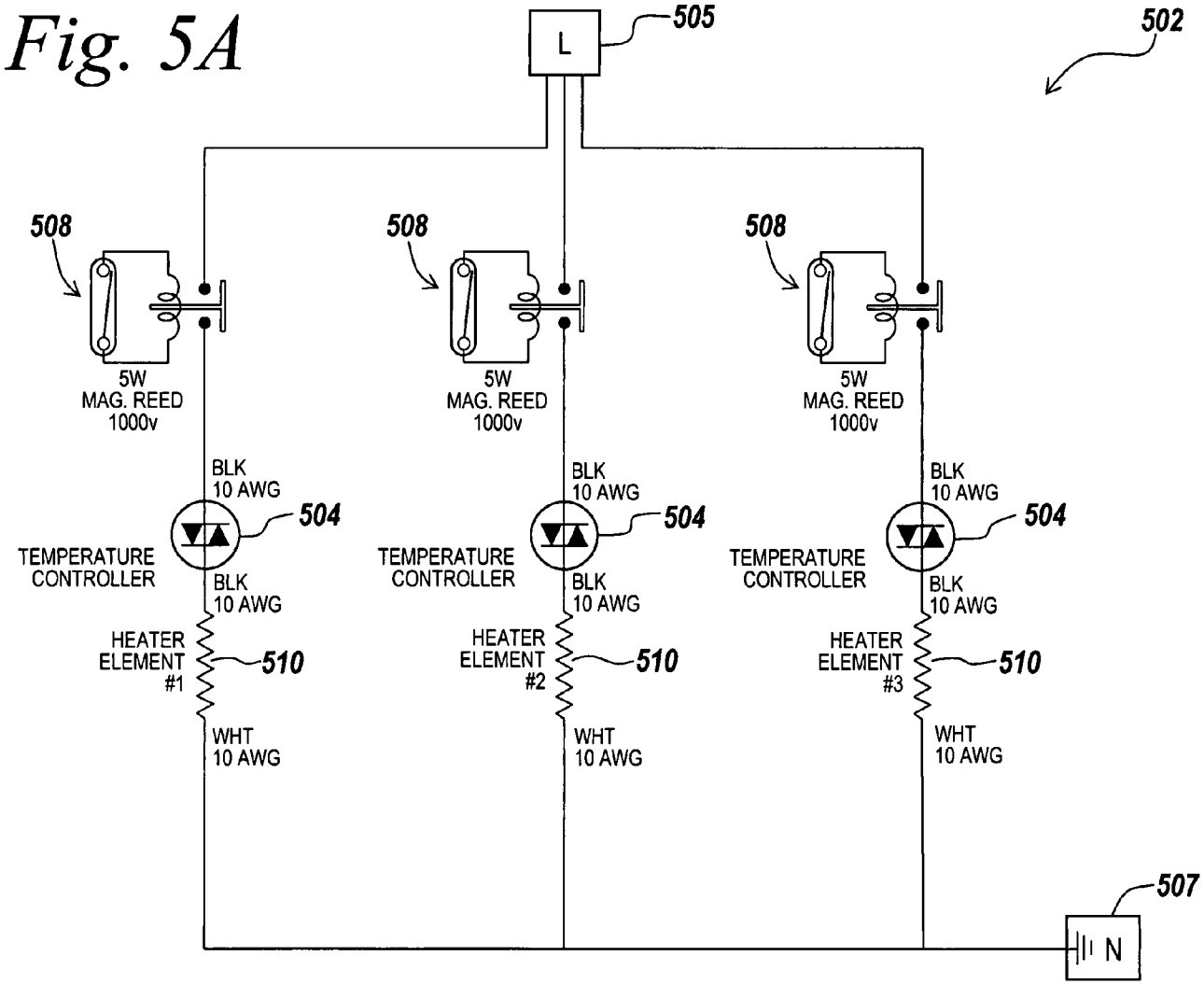
FIGS. 5A and 5B are schematic electrical diagrams of various embodiments of main electrical connection terminal for one or more switching units for an electric tankless liquid heater system in accordance with the present invention.
Figure 5B:
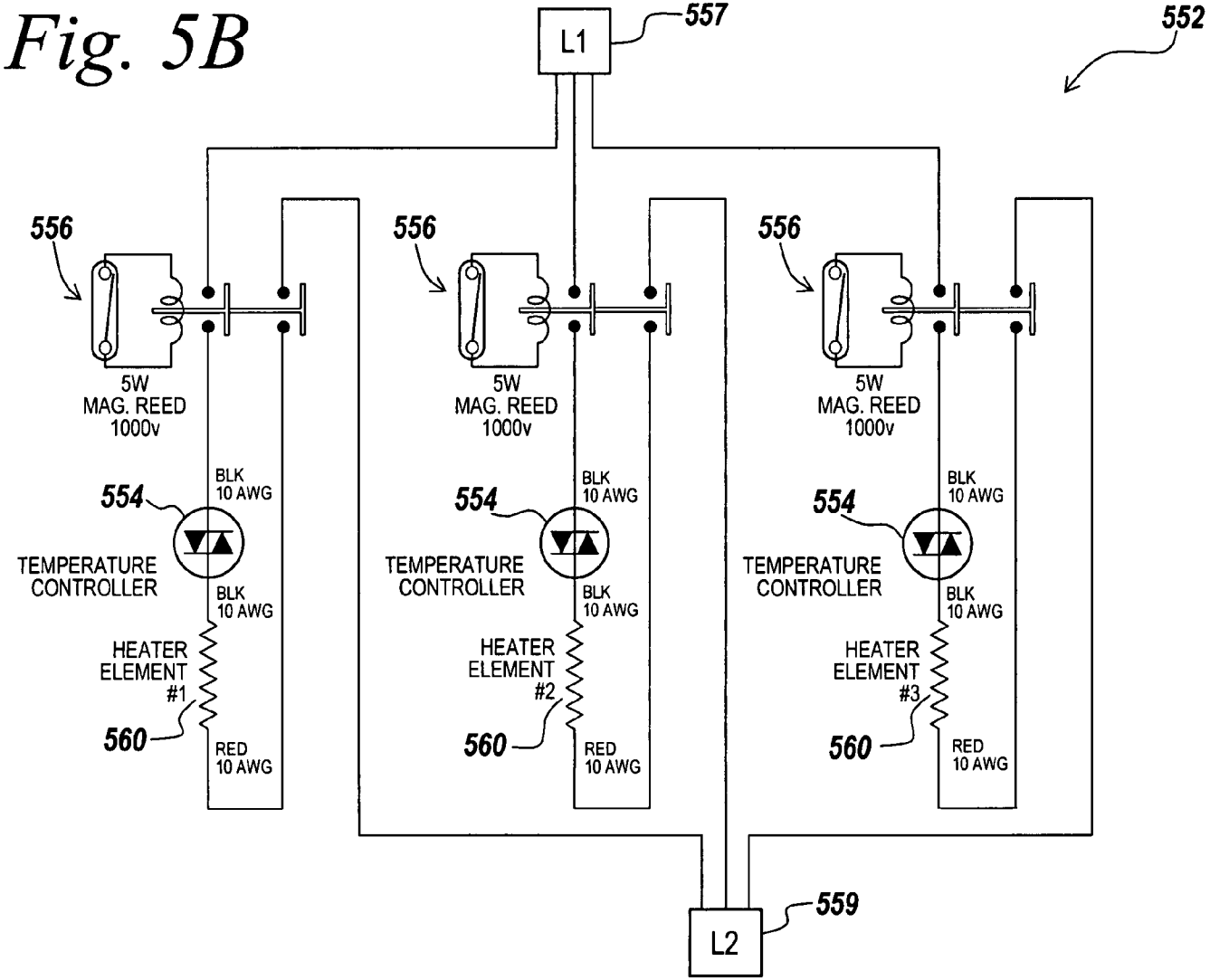

FIGS. 5A and 5B schematically illustrate various embodiments of main electrical connection for switching units in series with a circuit relay for a liquid heater system in accordance with the present invention. FIG. 5A illustrates a configuration 502 for connecting a switching unit 504 (here a triac) to line voltage L, 505 and a ground N, 507. The configuration illustrated is for a typical 277 volt (V) application. Each switching unit 504 is electrically connected to line voltage L through a separate circuit relay 508 (such as, e.g., a 3 watt (W), 1000 V magnetic reed switch). The switching unit 508 is in turn electrically connected to a respective electrical resistance heating element 510 of a liquid heater (here, one element per liquid heater) and the circuit completed by electrical connection to a ground N, 507.

FIG. 5B illustrates a configuration 552 for connecting a switching unit 554 (here a triac) in series with a circuit relay 556 to two 120 V line voltages L1, 557 and L2, 559. The configuration illustrated is for a typical 208-240 V application. The switching unit 554 is electrically connected to the first line voltage L1, 557 through a circuit relay 556 (such as, e.g., a 3 W, 1000 V magnetic reed switch). The switching unit 554 is in turn electrically connected to a respective electrical resistance heating element 560 of a liquid heater (here, one element per liquid heater). The circuit is completed for each electrical resistance-heating element 560 by electrical connection to the second line voltage L2, 559 through a circuit relay 556.

In preferred embodiments, the tankless liquid heater of the present invention includes a controller, which provides thermostatic control, for example, by monitoring one or more of liquid outlet temperature, inlet flow rate, and outlet flow rate; and adjusting the energization of liquid heaters and the current flow to the electrical resistance heating elements to facilitate maintaining liquid outlet temperature below a maximum temperature value. In various embodiments, the maximum temperature value is in the range between about 102° F. to about 106° F., and preferably the maximum temperature value is about 105° F.

In various embodiments, the tankless liquid heater of the present invention includes a controller, which provides thermostatic control, for example, by monitoring one or more of liquid outlet temperature, inlet flow rate, and outlet flow rate; and adjusting the energization of liquid heaters and the current flow to the electrical resistance heating elements to facilitate maintaining liquid outlet temperature within a selected temperature range. In various embodiments, the selected temperature range is the range between about 100° F. to about 105° F., and preferably the selected temperature range is the range between about 104° F. to about 105° F.

Preferably, the controller regulates a circuit relay installed in series with the switching unit to, for example, increase dielectric strength and with the ability to disarm the switching unit when the flow rate, as sensed by a flow sensor, is below a predetermined threshold value.

Figure 6:
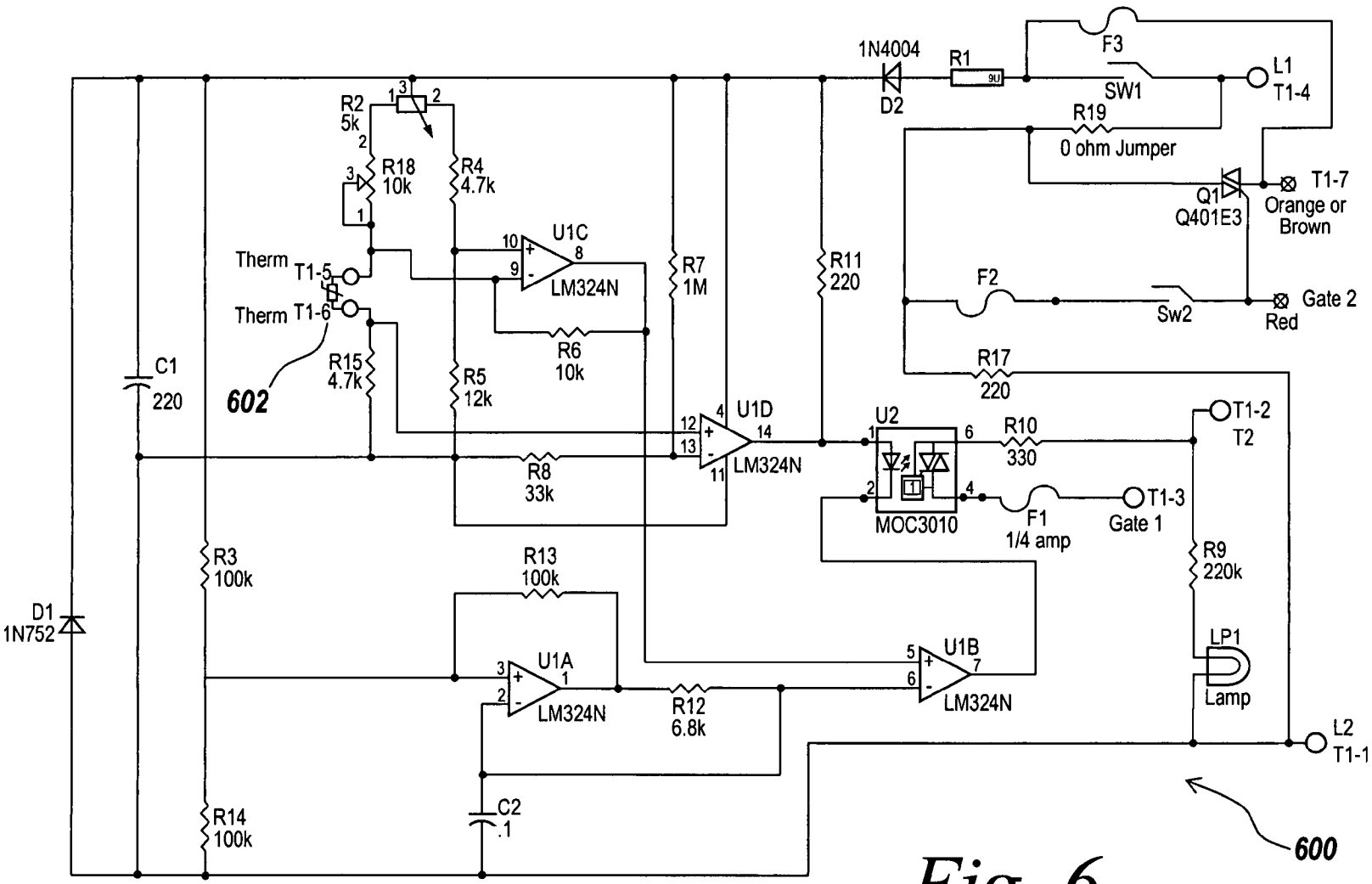
FIG. 6 is a schematic electrical circuit diagram of various embodiments of a controller for an electric tankless liquid heater system in accordance with the present invention.

Referring to FIG. 6, various embodiments of a controller are illustrated. Further details of the electrical components of FIG. 6 are provided in Tables 3 and 4 for two exemplary versions. In the schematic of FIG. 6, the control circuit 600 provides a control signal to one or more switching units on Gate 1 T1-3 and a control signal to one or more circuit relays on T1-7. It can be seen that the control signal for the one or more switching units is regulated by a trigger device U2 (here an optical coupler) which is triggered (here the light emitting diode is driven when triggered) in response to a signal from a temperature sensor 602 (here a thermistor). Typically, the trigger device is configured to turn the switching unit on at the zero-crossing to minimize radio frequency interference.

In operation, the temperature sensor 602 senses the liquid temperature thereby producing a signal, which is conditioned and amplified, and provided to the trigger device U2 (across pins 1 and 2 for the specific application illustrated using a MOC3010, ZCross Optocoupler from Motorola, Inc.). If the liquid temperature is adequately high for the selected temperature point (as controllably established by resistor R18), the control signal on output Gate 2 T1-3 will not cause the associated switching unit to energize the one or more electrical resistance heating elements connected thereto. In addition, if the liquid flow rate as sensed by the flow sensor is below a predetermined threshold level, the relay switches SW1 and SW2 will remain open, resulting in a control signal on T1-7 which causes the circuit relay to remain open and prevents current flow to the associated electrical resistance heating elements.

When the liquid temperature as sensed by the temperature sensor 602 falls below the temperature set point, the trigger device U2 is triggered (here, e.g., the light emitting diode emits), generating a control signal on output Gate 2 T1-3 permitting the associated switching unit to energize. However, for current flow to reach the one or more electrical resistance heating elements associated with the switching unit, the liquid flow rate, as sensed by the flow sensor, must also be equal to or above a predetermined threshold level to close the relay switches SW1 and SW2, resulting in a control signal on T1-7 which causes the circuit relay to close and permits current flow to the switching unit and associated one or more electrical resistance heating elements. For example, in various embodiments where the flow sensor comprises a rotometer including a magnetic portion configured to slidably respond to the liquid flow rate through a liquid heater, liquid flow through the liquid heater of equal to or above a predetermined flow rate threshold forces the magnetic portion to slide into an alignment with the relay switches SW1 and SW2 such that the switches close, permitting the energization of the associated electrical resistance heating element. The flow sensor thus providing a signal to the controller via the magnetic force exerted by the magnetic portion on the relay switches SW1 and SW2.

As will be see from the foregoing discussion and the drawings, the invention provides in various aspects a system for heating a liquid, such as, for example, water, comprising a plurality of liquid heaters, the inlets of which are connected in a parallel flow relationship by a manifold and the outlets of which are each connected to separate outlet conduits, and configured to deliver, in various embodiments, hot liquids, and in particular hot water, to an outlet conduit with less than about a: (i) 3° F. (about 1.7° C.); (ii) 2° F. (about 1.1° C.); (iii) 1.5° F. (about 0.8° C.); and/or (iv) 1° F. (about 0.6° C.); increase in output water temperature for a greater than about a: (i) one-and-a-half-fold decrease (i.e., about 33% reduction); (ii) two-fold decrease (i.e., 50% reduction); (iii) three-fold decrease (i.e., about 66% reduction); and/or (iv) four-fold decrease (i.e., 75% reduction); in water demand occurring in less than about: (i) 2 seconds; (ii) 1 second; (iii) 500 milliseconds; (iv) 250 milliseconds; (v) 75 milliseconds; and/or (vi) 50 milliseconds.

Accordingly, in various embodiments, the present invention provides tankless water heaters systems for provision of hot water to multiple water fixtures, and in particular, for example, to a group of automatic fixtures with frequent and rapid changes in hot water demand. Examples of such groups of fixtures and situations include, but are not limited to, multi-station wash basins in high traffic facilities (e.g., industrial washrooms at the end-of-shifts, washrooms in sports stadiums, etc.) and showers facilities with multiple concurrent users (e.g., locker room facilities, dorm facilities, mass decontamination situations, etc.).

TABLE 3

| Element | Device | Value, Version 1 | Value, Version 2 |
|---|---|---|---|
| C1 | Capacitor | 220 ufd/10 v | 220 ufd/10 v |
| C2 | Capacitor | 0.1/50 v | 0.1/50 v |
| D1 | Zener Diode | 1N752 | 1N752 |
| D2 | Diode | 1N4004 | 1N4004 |
| F1 | MCR-Fuse | 0.25 A | 0.25 A |
| F2 | MCR-Fuse | 0.25 A | not present |
| F3 | MCR-Fuse | not present | 0.25 A |
| LP1 | Neon Lamp | 2 ml LAMP | 2 ml LAMP |
| Q1 | 1A Triac | Q4 01E3 | Q4 01E3 |
| R1 | Power Resistor | see Table 4 below | see Table 4 below |
| R2 | Potentiometer | 5k | 5k |
| R3 | Resistor 1/4 W 5% | 100k | 100k |
| R4 | Resistor 1/4 W 5% | 4.7k | 4.7k |
| R5 | Resistor 1/4 W 5% | 12k | 12k |
| R6 | Resistor 1/4 W 5% | 10k | 10k |
| R7 | Resistor 1/4 W 5% | 1M | 1M |
| R8 | Resistor 1/4 W 5% | 33k | 33k |
| R9 | Resistor 1/4 W 5% | 220k | 220k |
| R10 | Resistor 1/4 W 5% | 330 | 330 |
| R11 | Resistor 1/4 W 5% | 220 | 220 |
| R12 | Resistor 1/4 W 5% | 6.8k | 6.8k |
| R13 | Resistor 1/4 W 5% | 100k | 100k |
| R14 | Resistor 1/4 W 5% | 100k | 100k |
| R15 | Resistor 1/4 W 5% | 4.7k | 4.7k |
| R17 | Resistor 1/4 W 5% | 220 | not present |
| R18 | Potentiometer | 10k | 10k |
| R19 | Resistor 1/4 W 5% | 0 ohm | 0 ohm |
| SW1 | Reedswitch | HYR2016 | HYR2016 |
| SW2 | Reedswitch | HYR2016 | not present |
| T1 | EDS500V-06-P-M | T-Block | T-Block |
| U1 | LM324N | LM324N | LM324N |
| U2 | ZCross Optocoupler | MOC3010 | MOC3010 |

TABLE 4

| Voltage | R1 Values |
|---|---|
| 120 V | 2.4k, 5 W |
| 208-240 V | 5k, 5 W |
| 277 V | 6.2k, 5 W |

EXAMPLES

The present invention will be more fully described by the following non-limiting examples. The following examples illustrate the effect of a sudden decrease in water demand (and concomitant increase in inlet water pressure and decrease in input water flow rate) on output water temperature.

Example 1

Examples of Temperature Spikes Using Traditional Heater Systems

In this example, measurements of output water temperature for various changes in input water flow rates were performed on two commercially available electric tankless water heaters (Heater A and Heater B) connected to a Bradley three-station sink (Bradley Corp., Menomonee Falls, Wis.). The faucets of the Bradley three-station sink were each controlled by a solenoid valve with a rated shutting time of 50 milliseconds.

Figure 7A:
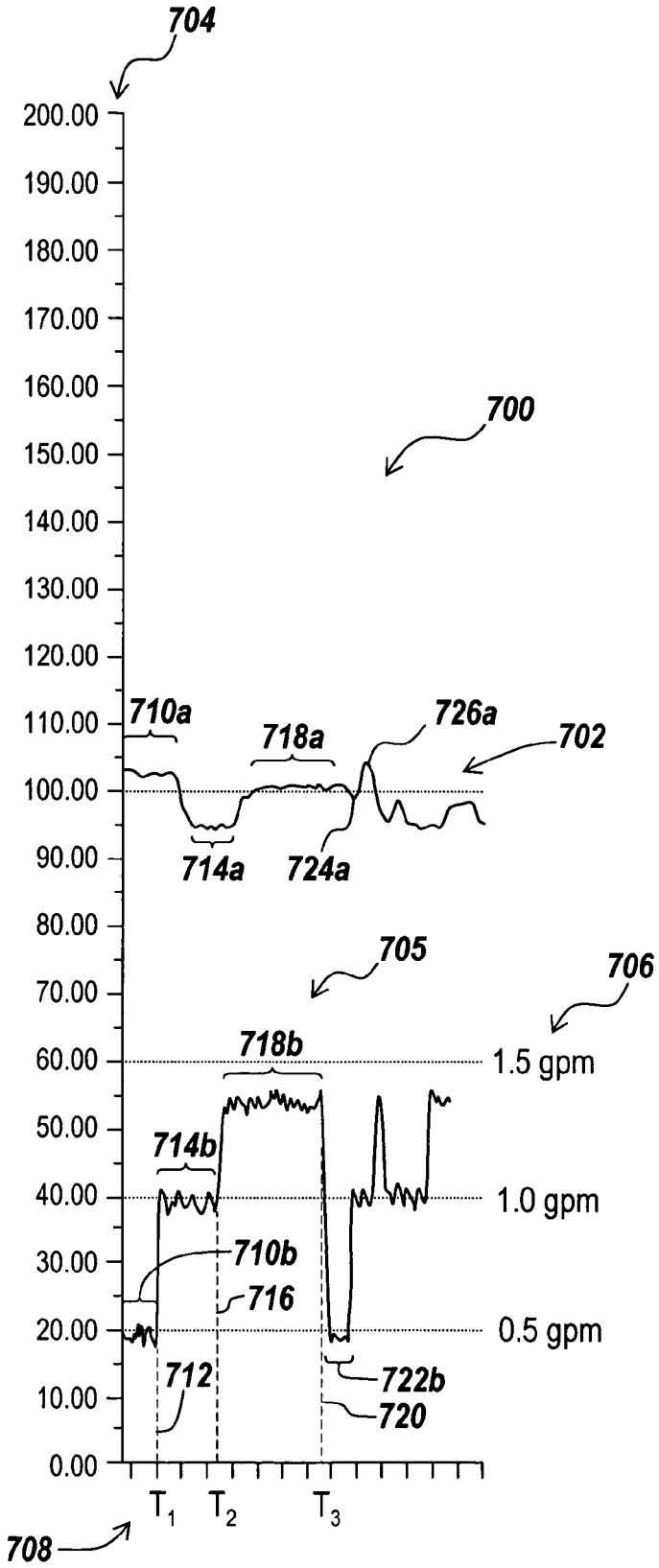
FIGS. 7A and 7B depict measurements of output water temperature for various changes in measured input water flow rates of two commercially available electric tankless water heater systems.
Figure 7B:
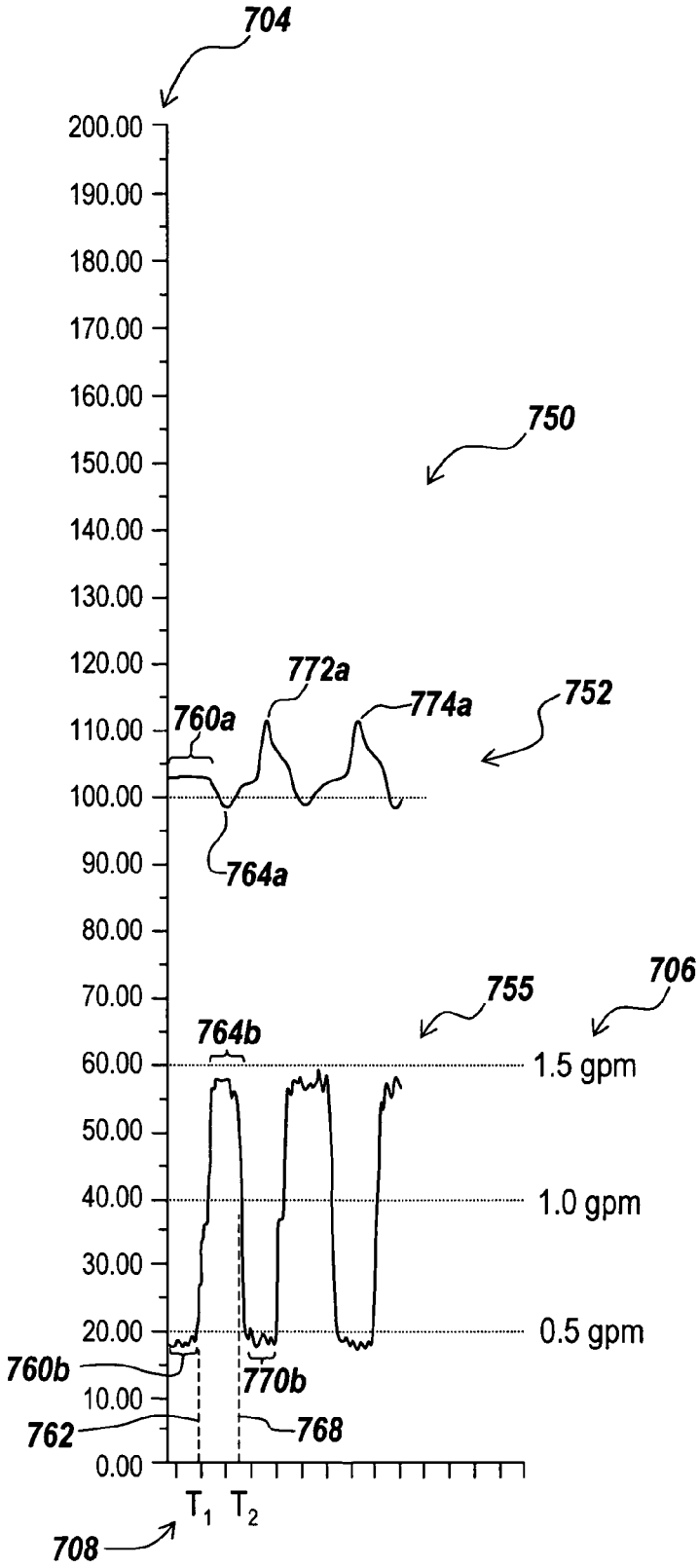

The data of FIGS. 7A and 7B was recorded using a Monarch Data Chart 4600 data acquisition recorder (Monarch Instruments, Amherst, N.H.). FIG. 7A depicts the measurements for Heater A. Heater A was an Eemax™ EX110TC model heater (available from Eemax, Inc., Oxford, Conn.). FIG. 7B depicts the measurements for Heater B. Heater B was a Chronomite™ E-90RL model heater (available from Chronomite Laboratories, Inc., Harbor City, Calif.).

Measurement of the input water flow rate was made using a rotometer (Kobold model DF paddle-wheel flow sensor, Kobold Instruments, Inc., Pittsburgh, Pa.) positioned in the end of a water supply line proximate to the inlet of the water heater system. The inlet water temperature was about 57° F. and the inlet water pressure was about 60 psi for an about 0.4 gpm to about 0.5 gpm inlet flow rate; about 40 psi for an about 0.8 gpm to about 1.0 gpm inlet flow rate; and about 25 psi for an about 1.3 gpm to about 1.5 gpm inlet flow rate.

The outlet water temperature displayed in FIGS. 7A and 7B was measured at faucet #3 of the Bradley three-station sink using an Omega type K (alumel-chromel) thermocouple (specifically Omega part no. TJ144-CASS-18U-4-FB-OST-M, Omega Engineering, Inc., Stamford, Conn.). A Fluke 51 type-K thermocouple thermometer was also used to measure outlet water temperature at faucet #3 to provide a measure of this temperature without the smoothing of the temperature readings that can occur with the Monarch data acquisition recorder, due to, for example, data acquisition rate and built-in smoothing functions.

In the measurements of FIGS. 7A and 7B faucet #3 of the Bradley three-station sink was maintained in a fully-open position and the other two faucets varied from fully-open to fully-closed. Each faucet of the three-station sink had a water demand of about 0.4 gpm to about 0.5 gpm.

Referring to the graph 700 of FIG. 7A, depicting the data provided by the Monarch data acquisition recorder, the upper trace 702 is the measured outlet water temperature at faucet #3 in degrees Fahrenheit (scale is on the left-axis of ordinates 704) at the inlet flow rate of the lower trace 705 (scale in gallons per minute is given on the right-axis of ordinates 706). The traces are taken as a function of time (x-axis 708) where each division on the x-axis represents 6 seconds.

For Heater A, the test was measurements were initiated with only faucet #3 fully-open: the outlet water temperature was about 104° F., region 710*a* on the upper trace 702, and the input flow rate was about 0.5 gpm, region 710*b* on the lower trace 705. Another faucet of the three-station sink was fully-opened at time $T_1$ (indicated approximately by dashed line 712) resulting in a decrease in temperature, region 714*a* on the upper trace 702, and a total hot water demand of about 0.95 gpm, region 714*b* on the lower trace 705. At time $T_2$ (indicated approximately by dashed line 716) the remaining faucet was fully-opened and a substantially stable outlet water temperature of about 100° F., region 718*a* on the upper trace 702, was reached for a total hot water demand of about 1.4 gpm, region 718*b* on the lower trace 705. At time $T_3$ (indicated approximately by dashed line 720) both faucets #1 and #2 of the sink were shut off, rapidly dropping the inlet flow rate from about 1.4 gpm to about 0.5 gpm, region 722*b* on the lower trace 705. The outlet water temperature, after an initial dip to about 98° F., (point 724*a* on the upper trace 702) spiked to about 104° F., (point 726*a* on the upper trace 702); resulting in a temperature spike of about 6° F. In addition, the Fluke 51 thermocouple thermometer at faucet #3 was observed to spike to about 107° F.

Referring to the graph 750 of FIG. 7B, depicting the data provided by the Monarch data acquisition recorder, the upper trace 752 is the measured outlet water temperature for Heater B in degrees Fahrenheit (scale is on the left-axis of ordinates 704) at the inlet flow rate of the lower trace 755 (scale in gallons per minute is given on the right-axis of ordinates 706). The traces are taken as a function of time (x-axis 758) where each division on the x-axis represents 6 seconds.

For Heater B, the test measurements were initiated with only faucet #3 fully-open: the outlet water temperature was about 104° F., region 760*a* on the upper trace 752, and the input flow rate was about 0.5 gpm, region 760*b* on the lower trace 755. At time $T_1$ (indicated approximately by dashed line 762) the faucets #1 and #2 were fully-opened causing the outlet water temperature to dip to about 98° F., (point 764*a* on the upper trace 752) for an inlet flow rate of about 1.4 gpm, region 764*b* on the lower trace 752. At time $T_2$ (indicated approximately by dashed line 768) both faucets #1 and #2 of the sink were shut off, the inlet flow rate rapidly dropped from about 1.4 gpm to about 0.5 gpm, region 770*b* on the lower trace 755, and the outlet water temperature spiked to about 110° F., (point 772*a* on the upper trace 752); resulting in a temperature spike of about 12° F. In addition, the Fluke 51 thermocouple thermometer at faucet # 3 was observed to spike to about 118° F. A repeated test of the change in outlet water temperature upon rapid shut-off of two of the three faucets, again demonstrated a temperature spike to about 110° F., (point 774*a* on the upper trace 752) following the shut-off of faucets #1 and #2.

The observed temperature spikes for both Heater A and Heater B would typically be noticeable and uncomfortable to the average person, for example, washing their hands at faucet #3 of the sink. Water temperatures above 107° F. are generally considered too hot for hand washing by the average person. In particular, a temperature of 118° F. (the maximum spike observed for Heater B) would feel "scalding" to the average person and likely result in them reflexively jerking their hands away from the water stream.

Example 2

Temperature Variation Using an Embodiment of the Invention

In this example, measurements of output water temperature for various changes in measured input water flow rates were performed on an embodiment of an electric tankless water heater system of the invention ("the test water heater system") connected to the same Bradley three-station sink of Example 1. As in Example 1, the faucets of the Bradley three-station sink were each controlled by a solenoid valve with a rated shutting time of 50 milliseconds. As in Example 1, the data of FIGS. 8 and 9 was recorded using a Monarch Data Chart 4600 data acquisition recorder (Monarch Instruments, Amherst, N.H.). The test water heater system of Example 2 was substantially similar to that described in the context of FIGS. 1-6. The controller of the test water heater system was set to maintain the output water temperature at about 105° F.

Figure 8:
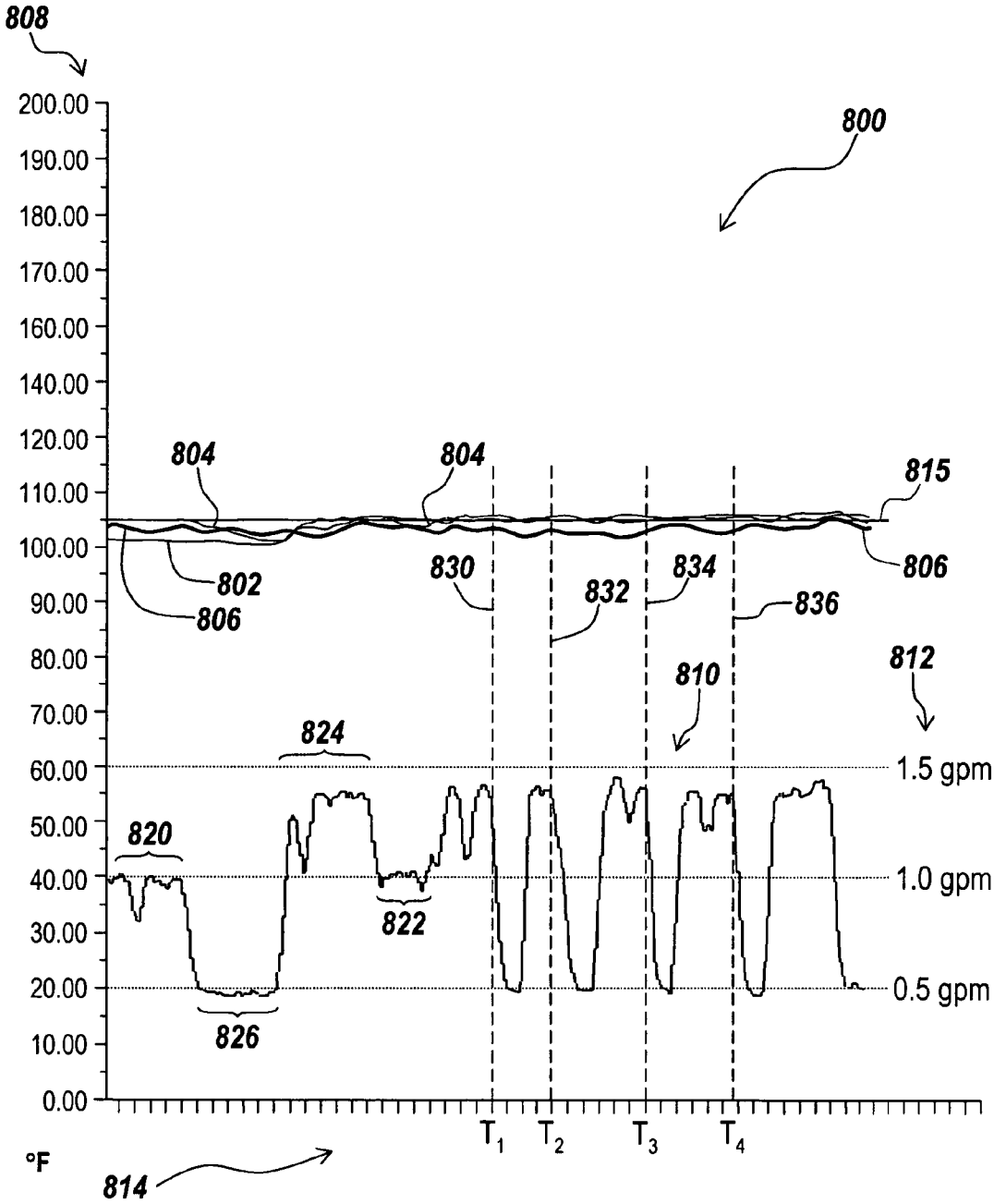
FIG. 8 depicts measurements of output water temperature for various changes in measured input water flow rates of an electric tankless water heater system in accordance with the present invention.

FIG. 8 depicts measurements of output water temperature for various changes in measured input water flow rates for the test water heater system. In the measurements of FIG. 8, faucet #3 of the Bradley three-station sink was maintained in a fully-open position and the other two faucets varied from fully-open to fully-closed. Each faucet of the three-station sink had a water demand of about 0.4 gpm to about 0.5 gpm.

Measurement of the input water flow rate was made using a rotometer (Kobold model DF paddle-wheel flow sensor, Kobold Instruments, Inc., Pittsburgh, Pa.) positioned in the end of a water supply line proximate to the inlet of the water heater system. The inlet water temperature was about 57° F. and the inlet water pressure was about 94 psi for an about 0.4 gpm to about 0.5 gpm inlet flow rate; about 86 psi for an about 0.9 gpm to about 1.0 gpm inlet flow rate; and about 77 psi for an about 1.3 gpm to about 1.4 gpm inlet flow rate.

Outlet water temperature was measured at each faucet of the Bradley three-station sink using an Omega type K thermocouple (specifically Omega part no. TJ144-CASS-18U-4-FB-OST-M, Omega Engineering, Inc., Stamford, Conn.).

Referring to the graph 800 of FIG. 8, depicting the data provided by the Monarch data acquisition recorder, the upper three traces 802, 804, 806 are the measured outlet water temperature for the test water heater system in degrees Fahrenheit (scale is on the left-axis of ordinates 808) at the inlet flow rate of the lower trace 810 (scale in gallons per minute is given on the right-axis of ordinates 812). The trace for the output water temperature of faucet #3 806 has been indicated by a thicker line to distinguish it from the traces for faucets #1 802 and faucet #2 804. The traces are taken as a function of time (x-axis 814) where each division on the x-axis represents 1.5 seconds. The temperatures set point, 105° F., is also indicated by a solid line 815.

For the test water heater system, the measurements were initiated with a series of measurements with two of the three faucets fully-open (regions 820, 822 on the lower trace 810), all three of the faucets fully open (region 824 on the lower trace 810) and only faucet #3 open (e.g., region 826 on the lower trace 810) to evaluate the response of the test water heater system and the measurement equipment, prior to evaluation of the system for temperature spikes. A series of measurements where then made of the temperature variation at faucet #3 due to the rapid shut off of the other two faucets.

For example, at each of times $T_1$-$T_4$ (indicated approximately by dashed line 830, 832, 834 and 836, respectively) the water demand of both faucets #1 and #2 was shut-off substantially simultaneously using their associated solenoid valves, with a shut-off time of about 50 milliseconds. As can be seen from the lower trace 810, the decrease in inlet flow rate, from about 1.4 gpm to about 0.5 gpm, occurred in less than about 2 seconds.

Figure 9:
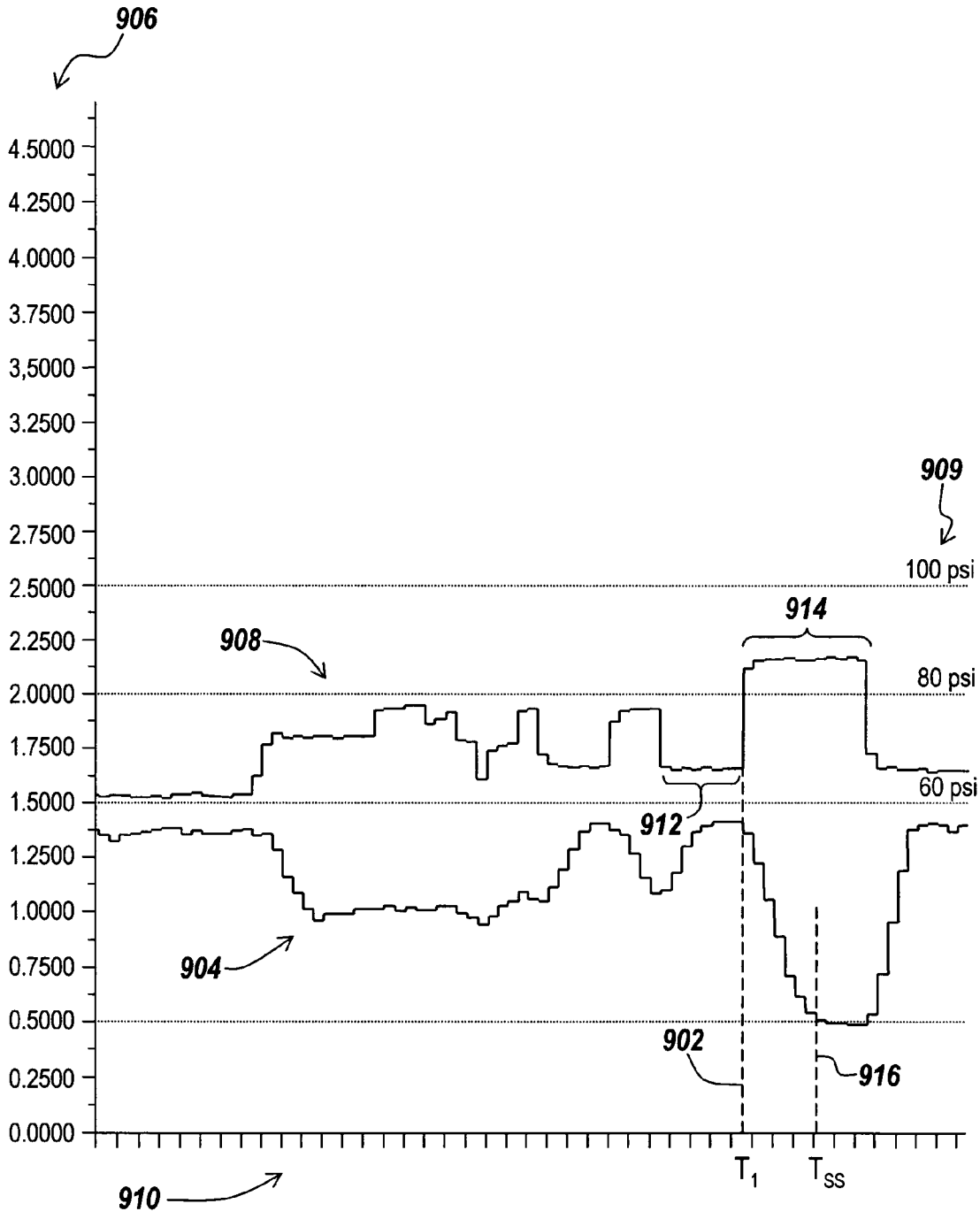
FIG. 9 depicts an expanded view of a portion of FIG. 8.

FIG. 9 provides an expanded time axis view of FIG. 8 about the first shut-off test time $T_1$ (indicated approximately by dashed line 902). The lower trace 904 is the measured inlet flow rate (scale in gallons per minute is given on the left-axis of ordinates 906) and the upper trace 908 is the measured inlet water pressure in pounds per square inch (psi) (scale in psi is given on the right-axis of ordinates 909), which shows a faster response to changes in water demand than the measured flow rate. The traces are taken as a function of time (x-axis 910) where each division on the x-axis represents 0.5 seconds and where the sampling rate was 250 milliseconds. As can be seen in the upper trace 908, the inlet water pressure responds to the decrease in water demand in a time less than the data acquisition rate of 250 milliseconds; rising from a measured value of 66.3 psi (region 912 of the upper trace 908) to a measured value of 84.7 psi (region 914 of the upper trace 908). The lower trace illustrates the response of the measured inlet flow rate to the decrease in water demand; the measured inlet flow rate reaching a value of about 0.5 gpm at about time $T_{SS}$ (indicated approximately by dashed line 916); approximately 1.75 seconds after time $T_1$. It should be understood that the longer response time of the measured inlet flow rate to changes in water demand, as compared to, for example, the change in inlet water pressure, is due in part to the response of the flow sensors and the smoothing functions employed on the inlet flow rate data channel on the Monarch data acquisition recorder. In various preferred embodiments, the time it takes for the decrease in liquid demand to occur is preferably measured by the increase time of the inlet liquid pressure.

Referring again to FIG. 8, as can be seen from the trace of the outlet water temperature at faucet #3 806, the water temperature at faucet #3 varies by less than 2° F. after the sudden shut off of faucets #1 and #2 at times $T_1$-$T_4$; and no temperature spikes above the temperature set point of 105° F. are observed.

The claims should not be read as limited to the described order or elements unless stated to that effect. While the invention has been particularly shown and described with reference to specific illustrative embodiments, it should be understood that various changes in form and detail may be made without departing from the spirit and scope of the invention as defined by the appended claims. By way of example, any of the disclosed features can be combined with any of the other disclosed features to a produce an electric tankless liquid heater. Therefore, all embodiments that come within the scope and spirit of the following claims and equivalents thereto are claimed as the invention.

What is claimed is:

1. A tankless liquid heater comprising:

an inlet manifold;

a plurality of liquid heaters each having a liquid inlet and a liquid outlet, the liquid inlets of the plurality of liquid heaters being connected in a parallel flow relationship by the inlet manifold and each of the plurality of liquid heaters having one or more electrical resistance heating elements for heating liquid flowing through said liquid heater; each of the plurality of liquid heaters further comprising:

a housing having a liquid inlet channel integrally including the liquid inlet and a liquid outlet channel integrally including the liquid outlet, the housing defining a central passage opening into an exterior housing surface;

and a heating cartridge resident in the central passage, the heating cartridge supporting interiorly of the housing the one or more electrical resistance heating elements;

and a separate outlet conduit connected to the liquid outlet of each liquid heater; wherein the plurality of liquid heaters is adapted to deliver water with less than about a 3° F. increase in output water temperature upon about a two-fold or greater decrease in water demand, the decrease in water demand occurring in less than about 2 seconds.

2. The tankless liquid heater of claim 1, wherein the tankless liquid heater is capable of delivering water with less than about a 2° F. increase in output water temperature.

3. The tankless liquid heater of claim 1, wherein the tankless liquid heater is capable of delivering water with less than about a 1° F. increase in output water temperature.

4. The tankless liquid heater of claim 1, wherein the decrease in water demand is about a three-fold or greater decrease in water demand.

5. The tankless liquid heater of claim 1, wherein the outlet water temperature is in the range between about 104 to about 106° F. prior to the decrease in water demand.

6. The tankless liquid heater of claim 1, wherein the input water flow rate is in the range between about 0.5 gpm to about 1.5 gpm prior to the decrease in water demand.

7. The tankless liquid heater of claim 1, wherein the decrease in water demand occurs in less than about 1 second.

8. The tankless liquid heater of claim 1, wherein the decrease in water demand occurs in less than about 500 milliseconds.

9. The tankless liquid heater of claim 1, wherein the decrease in water demand occurs in less than about 250 milliseconds.

10. The tankless liquid heater of claim 1, wherein the decrease in water demand occurs in less than about 75 milliseconds.

11. The tankless liquid heater of claim 1, wherein the time it takes for the decrease in water demand to occur is determined by a time during which the inlet liquid pressure increases substantially.

12. The tankless liquid heater of claim 1, wherein the plurality of liquid heaters comprises 3 or more liquid heaters.

13. The tankless liquid heater of claim 1, wherein the one or more electrical resistance heating elements are sheathless.

14. The tankless liquid heater of claim 1, wherein the one or more electrical resistance heating elements each include a mechanically stressed portion and an electrically conductive member configured to substantially eliminate electrical current flow through the mechanically stressed portion.

15. The tankless liquid heater of claim 1, wherein one or more of the first plurality of liquid heaters further comprise a flow sensor operably disposed in the liquid inlet channel.

16. The tankless liquid heater of claim 15, wherein the flow sensor is configured to provide a signal to a controller, the controller configured to prevent energizing an electrical resistance heating element of the liquid heater until the flow rate of the liquid through the liquid inlet channel exceeds a predetermined flow rate threshold.

17. The tankless liquid heater of claim 1, wherein one or more of the first plurality of liquid heaters further comprise a temperature sensor operably disposed in the liquid outlet channel.

18. The tankless liquid heater of claim 17, further comprising a controller configured to regulate electrical current flow to one or more electrical resistance heating elements in response to a signal produced by the temperature sensor to maintain an the outlet water temperature below a maximum temperature value in the range between about 102° F. to about 106° F.

19. The tankless liquid heater of claim 17, further comprising a controller configured to regulate electrical current flow to one or more electrical resistance heating elements in response to a signal produced by the temperature sensor to maintain an the outlet water temperature in the range between about 100° F. to about 105° F.

20. The tankless liquid heater of claim 19, wherein the controller is configured to maintain an the outlet water temperature in the range between about 104° F. to about 105° F.

21. A tankless liquid heater comprising:

an inlet manifold;

a plurality of liquid heaters each having a liquid inlet and a liquid outlet, the liquid inlets of the plurality of liquid heaters being connected in a parallel flow relationship by the inlet manifold and each of the plurality of liquid heaters having one or more electrical resistance heating elements for heating liquid flowing through said liquid heater;

the first plurality of liquid heaters comprising:

a housing having a liquid inlet channel integrally including the liquid inlet and a liquid outlet channel integrally including the liquid outlet, the housing defining a central passage opening into an exterior housing surface;

a heating cartridge resident in the central passage, the heating cartridge supporting interiorly of the housing the one or more electrical resistance heating elements; and each of the electrical resistance heating elements having a mechanically stressed portion and an electrically conductive member configured to substantially eliminate electrical current flow through the mechanically stressed portion;

a temperature sensor operably disposed in the liquid outlet channel of one or more of the liquid heaters;

a controller configured to regulate electrical current flow to one or more electrical resistance heating elements in response to a signal produced by the temperature sensor to maintain an the outlet water temperature in the range between about 100° F. to about 105° F.; and a separate outlet conduit connected to the liquid outlet of each liquid heater;

wherein the plurality of liquid heaters is adapted to deliver water with less than about a 2° F. increase in output water temperature upon about a two-fold or greater decrease in water demand, the decrease in water demand occurring in less than about 500 milliseconds.

22. The tankless liquid heater of claim 21, wherein the sudden decrease in water demand occurs in less than about 250 milliseconds.

23. The tankless liquid heater of claim 21, wherein the sudden decrease in water demand occurs in less than about 75 milliseconds.

24. The tankless liquid heater of claim 21, wherein the time it takes for the decrease in water demand to occur is determined by a time during which the inlet liquid pressure increases substantially.

25. The tankless liquid heater of claim 21, wherein the tankless liquid heater is capable of delivering water with less than about a 1° F. increase in output water temperature.

26. The tankless liquid heater of claim 21 wherein the decrease in water demand is about a three-fold or greater decrease in water demand.

27. The tankless liquid heater of claim 21 wherein the outlet water temperature is in the range between about 104 to about 106° F. prior to the decrease in water demand.

28. The tankless liquid heater of claim 21, wherein the input water flow rate is in the range between about 0.5 gpm to about 1.5 gpm prior to the decrease in water demand.

29. The tankless liquid heater of claim 21, wherein the one or more electrical resistance heating elements are sheathless.

* * * * *